US009913025B2

(12) United States Patent
Zanella

(10) Patent No.: US 9,913,025 B2
(45) Date of Patent: Mar. 6, 2018

(54) HIGH MUSICAL DEFINITION ACOUSTIC RESONATOR

(71) Applicant: Martin Pedro Carrasco Zanella, Metepec (MX)

(72) Inventor: Martin Pedro Carrasco Zanella, Metepec (MX)

( * ) Notice: Subject to any disclaimer, the term of this patent is extended or adjusted under 35 U.S.C. 154(b) by 0 days.

(21) Appl. No.: 15/182,713

(22) Filed: Jun. 15, 2016

(65) Prior Publication Data

US 2016/0366512 A1 Dec. 15, 2016

(30) Foreign Application Priority Data

Jun. 15, 2015 (MX) ..... MX/A/2015/007653

(51) Int. Cl.

| | |
|---|---|
| ***H04R 1/20*** | (2006.01) |
| ***H04R 1/34*** | (2006.01) |
| ***H04R 1/02*** | (2006.01) |

(52) U.S. Cl.
CPC ..... *H04R 1/345* (2013.01); *H04R 1/026* (2013.01)

(58) Field of Classification Search
CPC ..... H04R 1/026; H04R 1/345
See application file for complete search history.

(56) References Cited

U.S. PATENT DOCUMENTS

| | | | | |
|---|---|---|---|---|
| 8,194,905 | B1 | 6/2012 | Vinther | |
| 8,205,712 | B2 * | 6/2012 | Dickie | H04R 1/2819 181/151 |
| 8,457,341 | B2 | 6/2013 | Danley | |
| 8,637,756 | B1 * | 1/2014 | Brawley | G10G 7/005 84/453 |
| 2008/0295669 | A1 * | 12/2008 | Hashimoto | G10D 9/026 84/387 R |
| 2014/0291065 | A1 | 10/2014 | Kim | |

* cited by examiner

*Primary Examiner* — Tuan D Nguyen
(74) *Attorney, Agent, or Firm* — McCarter & English, LLP; Yu Lu; Vadim Cherkasov

(57) ABSTRACT

The present invention relates to a high-efficiency, full range acoustic resonator that functions as a high musical definition loudspeaker. It does not require electrical filters (crossover filters). The electrical signal from the amplifier directly passes to a single speaker, without energy losses and added distortions. Further, the acoustic resonator of the present invention does not require a loudspeaker enclosure to accommodate the speakers.

11 Claims, 9 Drawing Sheets

HIGH MUSICAL DEFINITION ACOUSTIC RESONATOR

REFERENCE TO RELATED APPLICATION

This application claims foreign priority under 35 U.S.C. § 119(a) to Mexican Patent Application No. MX/a/2015/007653, filed on Jun. 15, 2015, the entire contents of which are incorporated herein by reference and made a part of this specification.

FIELD OF THE INVENTION

The present invention relates to a high-efficiency, full-range acoustic resonator that functions as a high musical definition loudspeaker using a single speaker, unlike the three or more speakers needed in the prior art. The acoustic resonator of the present invention does not require electrical filters (crossover filters), which separate the frequencies for each speaker or loudspeaker as the prior art. The electrical signal from the audio amplifier goes directly to the speaker without energy losses and added distortions. In addition, the acoustic resonator of the present invention does not require an acoustic enclosure to accommodate speakers.

BACKGROUND OF THE INVENTION

Patent Application US 2014/0291065 A1 discloses a loudspeaker having an external extension that includes an enclosure, at least one speaker, and a port formed in a surface of the enclosure so as to communicate with a hollow extension extending from the port outwardly. The configuration of this loudspeaker is designed to reproduce low range frequencies only, damping or lowering both middle and high frequencies. In other words, this patent application is aimed to damp intermediate and high frequencies in order to emphasize low frequencies only.

U.S. Pat. No. 8,457,341 B2 discloses a sound reproduction system, in the form of a horn, having one or more drivers coupled to a sound barrier. Different frequency responses are obtained by altering areas and lengths of the system. As disclosed, the configuration of this patent is designed to reproduce, for example, only low frequencies, damping or lowering both middle and high frequencies.

U.S. Pat. No. 8,194,905 B1 discloses an apparatus comprising a high frequency horn placed within a low frequency horn, so that the emitted sounds are time aligned, and the sounds overlapping at the same frequencies do not cancel or cause significant interference or sound distortion. This technique uses two or more speakers.

Prior art traditional loudspeakers are basically made up of three main elements or parts.

1.-Dynamic speaker(s);

2.-Frequency dividers or crossover filters;

3.-Loudspeaker enclosures.

The dynamic speaker is an electroacoustic transducer, as its function is to transform electrical energy from an audio amplifier into acoustic energy perceivable by the human ear. Usually, said prior art technique uses three speakers in order to cover all of the frequencies that the human ear is able to hear. A low-frequency reproducing speaker (bass), middle-frequency reproducing speaker (mids), and high-frequency reproducing speaker (highs). These three speakers cover together, in theory, all of the frequencies that the human ear is able to hear, namely from about 20 Hertz up to 20,000 Hertz. In some cases, said technique uses more than one speaker for each "pathway". This means that in said technique there are loudspeakers with two or more low-frequency reproducing speakers (bass), two or more middle-frequency reproducing speakers (mids), and two or more high-frequency reproducing speakers (highs).

Given that the signals from an audio amplifier contain all of the audible frequencies (20 Hertz to 20,000 Hertz), it is necessary to separate, in a certain way, the frequencies that each of the speakers are able to reproduce.

In order to achieve this, said technique uses frequency dividers or crossover filters. This means that in the entrance of the frequency dividers we have the signal from the audio amplifier, and in the exit of the frequency divider we have three outputs. This makes possible that the low-frequency reproducing speaker (bass) only receives low frequencies (first output), that the middle-frequency reproducing speaker (mids) only receives middle frequencies (second output), and finally, that the high-frequency reproducing speaker (highs) only receives high frequencies (third output). There are well known techniques for designing these kinds of frequency dividers based on the characteristics of the speakers used.

Lastly, said technique uses different kinds of enclosures to accommodate therein the three speakers or more, along with the frequency dividers. Below, two traditional basic forms of constructing loudspeaker enclosures using said technique are mentioned.

Hermetically Sealed Loudspeaker Enclosure

A completely-sealed, rectangular enclosure made from pressed sawdust "MDF" accommodating speakers and frequency dividers.

Bass-Reflex Enclosure Having a Vent

Enclosure containing one or more vents generally located in the front surface thereof. Said loudspeaker enclosures are made from pressed sawdust "MDF". The vent(s) can be simply a port in the front cover of the enclosure or can be made with one or more plastic ducts, with specific length and diameter. This vent makes possible to tune the loudspeaker enclosure to the natural resonance frequency of the low-frequency reproducing speaker. This tuning is achieving by using Helmholtz resonance. By tuning the loudspeaker enclosure atresonance frequency of the low-frequency reproducing speaker (bass), the loudness of the bass response is emphasized just for that resonance frequency.

In said technique, usually the two types of loudspeaker enclosures are filled inside with an acoustic absorbent material. Typically fiberglass wool to avoid to some extent, the undesirable wave reflections produced inside thereof.

The fact that speakers of said technique are not sufficiently efficient to reproduce by themselves all of the frequencies that we can hear, forces to modify the original signal from the audio amplifier. This is because the original signal from the audio amplifier has to be divided or separated in three signals of different frequency in order to lead these signals to each of the speakers. The original signal from the audio amplifier is not the same anymore; low range frequency, middle range frequency and high range frequency are taken out from the original signal to send them all afterwards to each speaker. This separation has to be done by using frequency dividers or crossover filters.

When a frequency divider is interposed between the original signal from the audio amplifier and the speakers, various problems affecting the final reproduction of the sound emitted by the speakers of the system as a whole are presented.

Frequency dividers or crossover filters have inevitably electrical energy losses. So, from the total energy of the original signal from the audio amplifier entering them, only a portion will eventually reach the speakers Moreover, the elements used in frequency divider such as coils, electrical resistances and capacitors modify the original signal introducing "electric noise" or current and voltage distortion in the form of harmonics. The original signal from the audio amplifier now has harmful elements that not presented before at the crossover filter output.

In other words, passive electrical elements used to separate or divide the original signal from the output amplifier into three different frequency ranges, damage and draw energy from the original signal.

Another disadvantage of frequency dividers used in said technique is that they produce the well-known "phase" distortion. This distortion is due to the time delay existing between the input signal to the frequency divider and the output signal therefrom, that will reach the speakers certain time later. This "phase" distortion produced by frequency dividers in the prior art affects the final audible quality of loudspeakers.

Another disadvantage of said technique is related with what occurs inside loudspeaker enclosures, either sealed or with vent, when the speakers are working. The low-frequency reproducing speaker (bass) generates significant air compressions and depressions inside the acoustic loudspeaker enclosures when the cones thereof move. They behave similar to a piston. The compression and depression generated inside the loudspeaker enclosure reaches the cones of the other speakers of the system, in opposite "phase", restricting its correct operation, mainly the operation of the middle-frequency reproducing speaker. Namely, when the electrical signal from the frequency divider makes the low-frequency speaker cone move forward, depression or vacuum is generated inside the loudspeaker enclosure. Said depression inside the loudspeaker enclosure "pulls" backward the middle-frequency speaker cone, but in that moment, the middle-frequency speaker also receives an electrical signal from the frequency divider, which tries to move it forward. Similarly, when the electrical signal from the frequency divider makes the low-frequency speaker cone move backward, a pressure inside the loudspeaker enclosure is generated, said pressure "pushes" forward the middle-range speaker cone, but in this moment, the middle-frequency speaker also receives an electrical signal from the frequency divider which tries to move it backward, so there are opposite forces in the cones of the low-frequency speaker and middle-frequency speaker, caused by this operation form. These opposite speaker cone forces diminish significantly the total system efficiency that finally results in a significant acoustic distortion and therefore, in a poor audible quality.

Therefore, an object of the present invention is to provide an acoustic resonator having a single high-efficiency, full range speaker, which can reproduce with high definition almost all of the sound frequencies that humans are able to hear, unlike the three or more speakers used by the prior art. Additionally, the frequency divider filters used in the prior art are eliminated. The rectangular loudspeaker enclosures made from pressed "MDF" wood, which house speakers in the prior art are also eliminated.

DETAILED DESCRIPTION OF THE INVENTION

Figure 1:
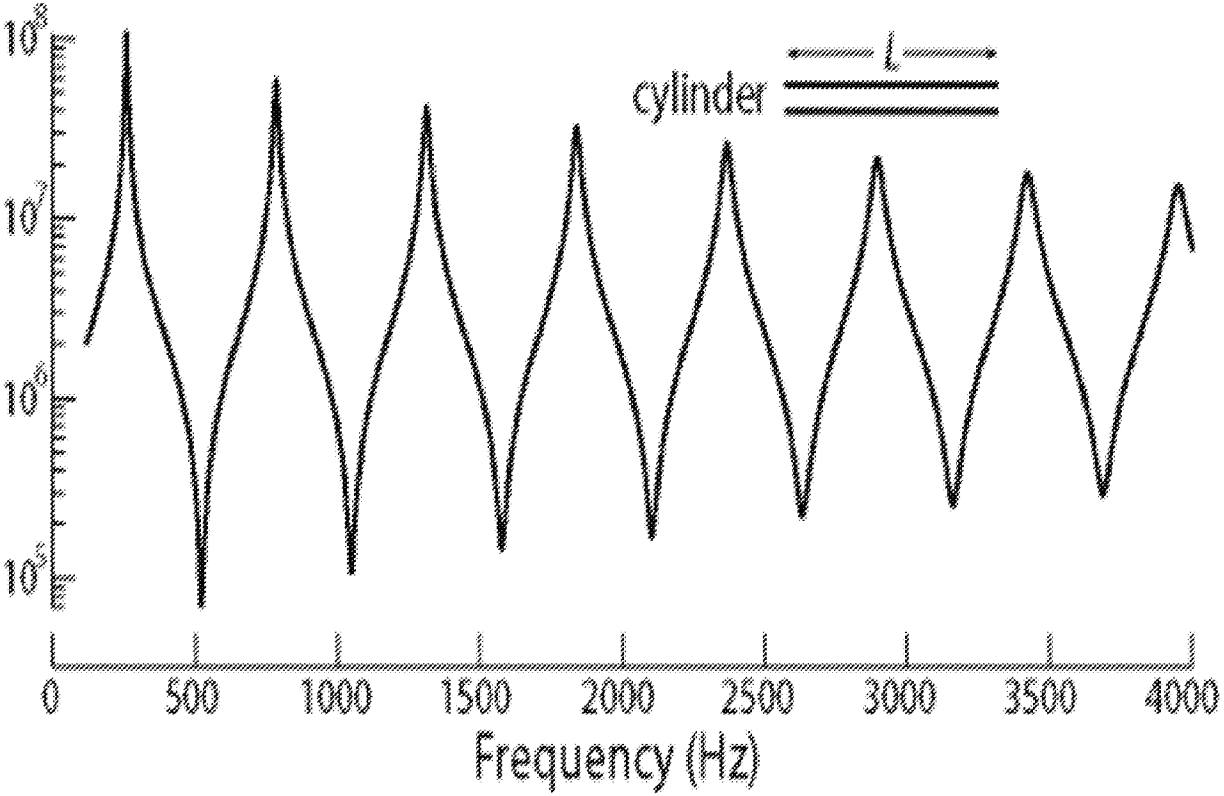
FIG. 1 shows a spectrum of the acoustic impedance of a cylinder.

The acoustic resonator of the present invention comprises a single speaker placed inside the larger diameter portion of a tapered nozzle; a duct connected at one end to the smaller diameter portion of the tapered nozzle, and connected at the other end to a musical wind instrument; whereby the air produced by the speaker goes through the tapered nozzle and duct, and enters the musical wind instrument making it resonate. The tapered nozzle is formed by two inner hollow profiles, a first cylindrical profile in the larger diameter portion of the tapered nozzle, that allows the speaker to be placed inside the tapered nozzle, and a second tapered profile in the smaller diameter portion of the nozzle, that allows the air produced by the speaker to be directed towards the duct.

The present invention uses a single speaker and eliminates the wood loudspeaker enclosure of the prior art, thus avoiding opposite forces of the cones of various speakers working at the same time, which limit the general system efficiency as explained above.

By eliminating wood loudspeaker enclosure and acoustic absorbent materials, undesirable reflections of the sound waves are avoided inside, keeping musical richness of the system in its entirety.

By eliminating frequency divider filters or crossover filters, there are no energy losses of the signal from the audio amplifier. Said signal passes directly from the audio amplifier output to the high efficiency, full range speaker. Moreover, by eliminating crossover filters of the prior art, it is possible to avoid inherent distortions thereof like phase distortion, among others.

In the present invention, the wood loudspeaker enclosure of the prior art is replaced by a tapered nozzle, which can be of solid pinewood, or any other material that does not present absorbent characteristics in the inner hollow profiles; a wind instrument such as a trumpet with its mouthpiece; and a duct connecting the tapered nozzle to the wind instrument at their ends, wherein said connecting duct can be "U"-shaped. Thus, a complex acoustic resonance system is formed, which instead of having forces that opposes the movement of the speaker cone, said forces make it work in resonance with the system as a whole, highlighting and detailing in a significant way the musical frequencies that it reproduces, thus creating a very pleasant and high definition audible sensation.

The construction and operation of the present invention are based on researches carried out on acoustical properties of trumpets and their mouthpieces. The acoustical properties of trumpets and their mouthpieces, along with high efficiency, full range speaker properties, can be used favorably to construct a "high musical definition acoustic resonator", which is an object of the present invention.

First Important Acoustic Property of Wind Musical Instruments

A characteristic concept of wind musical instruments is called acoustic impedance Z. The acoustic impedance Z is the ratio of acoustic pressure p, at the input of a system or wind musical instrument to the acoustic volume flow U therein. The acoustic impedance Z is defined mathematically as follows:

$$Z=p/U$$

Where p is the acoustic pressure at the entrance of the system and U is the acoustic volume flow inside the system.

Z usually changes its value strongly when the oscillatory frequency of the acoustic volume flow is changed inside the system. The acoustic impedance for a particular frequency is associated in turn with the acoustic intensity or loudness generated at the system output.

In the case of musical instruments as trumpets, the acoustic impedance Z has the advantage of being a physical property of the instrument per se. The acoustic impedance Z indicates the acoustic performance of the instrument in an objective way, regardless of who plays it, since it can be measured or calculated without the need of being played by a musician. The acoustic impedance Z is a spectrum because it has different values at different frequencies and its units are Pascal per second divided by cubic meter (Pa·s/m3)

FIG. 1 shows the spectrum of the acoustic impedance of a cylinder of 325 mm length and 15 mm diameter opened at both ends.

When an acoustic pressure p is generated in a certain way at the tube entrance, the air flow volume is measured inside the tube, and applying the equation Z=p/U, a curve is obtained as shown in FIG. 1. The acoustic impedance Z is represented on the "Y" axis, and the oscillation frequency of the air flow inside the tube is represented on the "X" axis.

Thus, the acoustic impedance Z of the spectrum shown in FIG. 1 indicates the ratio of the acoustic pressure p at the cylinder entrance to the air flow volume U inside said cylinder. It can be seen how acoustic impedance Z strongly changes with the frequency. It can also be seen how the acoustic impedance Z has different values at different frequencies. The high peaks of the acoustic impedance indicate that for that air volume flow frequency inside the tube, the acoustic intensity or loudness produced at its exit will also be a peak. As seen in FIG. 1, the high acoustic impedance peaks are of about 250 Hz, 750 Hz, 1,300 Hz, 1,800 Hz, and so on, until reaching the last acoustic impedance peak shown, approximately at 4,000 Hz. This graph indicates us, finally, the acoustic performance of a cylinder opened in both sides when it is excited with an acoustic pressure at its entrance. The acoustic impedance peaks mean loudness peaks at the tube exit at those frequencies. Therefore, when the acoustic excitement frequency at the tube entrance matches the peak frequency of impedance Z, the loudness at the tube exit at that frequency will increase similarly. The tube resonates inside at those frequencies, acoustically amplifying them at their output.

Figure 2:
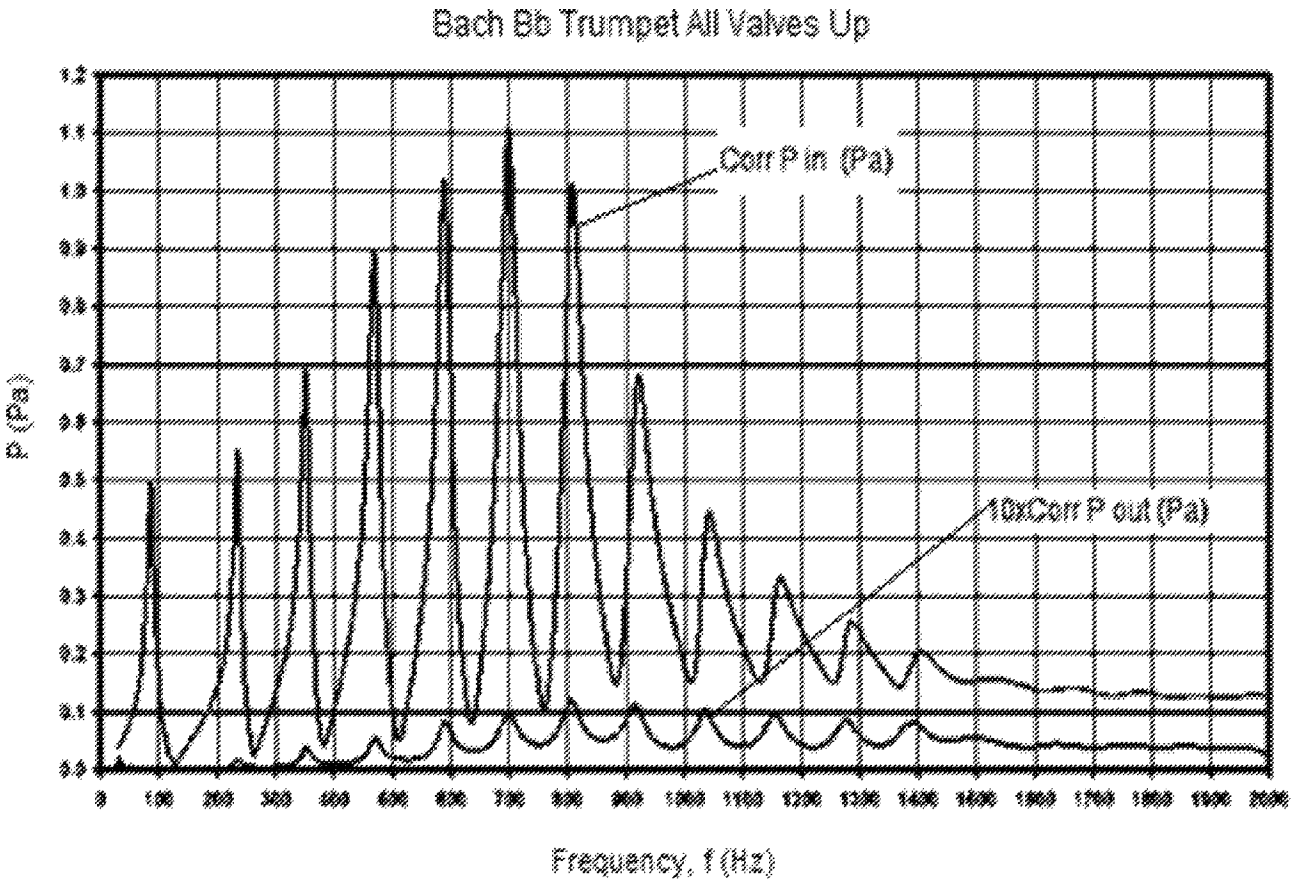
FIG. 2 shows the behavior of the acoustic impedance of a trumpet.

FIG. 2 shows acoustic impedance behavior of a real trumpet, unlike an opened tube at both ends.

As it can be seen in FIG. 2, the acoustic impedance behavior of a real trumpet is quite different from that of an opened cylinder at both ends. It can be seen that the first acoustic impedance peak of the trumpet is below 100 Hz. It can also be seen that the acoustic impedance peaks will increase until reaching a maximum at 700 Hz. After 700 Hz, these peaks gradually decrease until reaching a minimum at 1,400 Hz. After 1,400 Hz the acoustic impedance of the trumpet remains almost constant. Once again, the acoustic impedance Z peaks of the trumpet will cause acoustic resonance peaks at the exit thereof at those frequencies, as shown in the lower curve B of FIG. 2. It should be mentioned that the acoustic impedance of a trumpet and the loudness outside are two different things. The acoustic impedance is a physical property of the trumpet and the loudness is the acoustic power of the sounds said trumpet emits. The acoustic power or loudness is measured in dB or decibels.

Having said that, if a trumpet is acoustically excited in a certain way at the entrance of its mouthpiece with a speaker, important acoustic resonances can be obtained at its exit when the frequencies reproduced by the speaker match the acoustic impedance peaks of the trumpet. The acoustic pressure produced by a speaker at the trumpet mouthpiece entrance corresponds to the musical notes of many instruments playing at the same time, therefore, at the trumpet exit one obtains important acoustic resonances of all of these musical frequencies when they match the acoustic impedance peaks of the trumpet. This fact produces, as an audible effect, an extraordinary musical definition, which is an object of the present invention.

Second Important Acoustic Property of Musical Wind Instruments

Another well-known theory that supports the construction of the present invention is related to the harmonic analysis of the mathematician Jean-Baptiste Joseph Fourier. According to this analysis it has been possible to demonstrate that any musical note of frequency f contains integer multiples of that frequency, 2f, 3f, 4f and so on. These integer multiples of the fundamental f frequency are known as harmonics. The mathematical study of the superposition of these integer multiples of the fundamental frequency is known as Fourier harmonic analysis. According to this theory, the tone of a single musical note, for example, is not only made up of the fundamental frequency f of that tone, but also contains n number of harmonics that are integer multiples thereof, so that the "tone quality" of that particular note is not only given by the fundamental frequency, but also by the superposition of the fundamental frequency with all of its harmonics.

The most convenient form of measuring the power of the fundamental frequency and the power of the harmonics that make up it, are those known as Fourier spectrums. There are specialized electronic devices for making this measurement.

Figure 3:
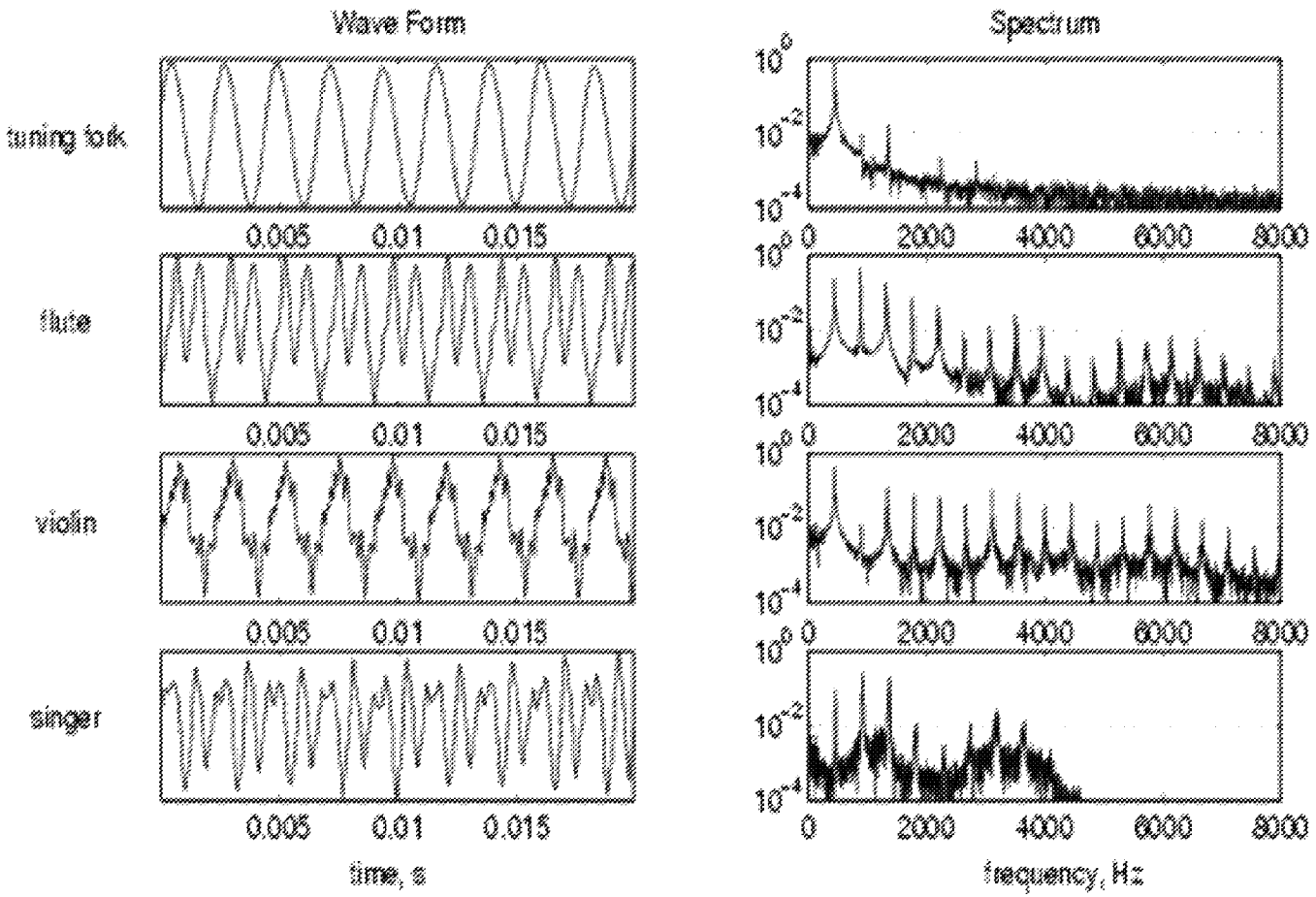
FIG. 3 shows four examples of simple musical waves and their corresponding harmonic spectrum.

FIG. 3 shows four simple musical waveform examples. Each waveform corresponds to a single musical tone with a certain frequency. At the left of FIG. 3, we can see the instruments that produce simple musical tones, and at the right, their corresponding Fourier spectrums. Each peak observed in the Fourier spectrums at the right corresponds to simple musical tones that contain harmonics at the left. As it can be seen, one single note of flute and one single note of violin are made up by an important amount of harmonics.

The researcher in Acoustics James Boyk, from the California Technological Institute has demonstrated that trumpets can generate important amounts of harmonics not only within the frequency ranges that the human ear can hear, of from 20 Hz to 20 KHz. They also generate harmonics above 20 KHz and up to 70 KHz. In this research James Boyk asks himself if the existence of this energy in the form of harmonics above the frequencies that we can hear, affects our perception of music. He mentions that common sense indicates us that harmonics above 20 KHz do not matter, and that they should not change our perception of music because we are not able to hear them. Nevertheless, the researcher makes reference to the article 3207 published by the Audio Engineering Society (AES), where it is demonstrated that, using electroencephalograms in volunteers, frequencies above 26 KHz activate "alpha" waves in our brain, favorably changing our music quality perception. Another important fact of using trumpets in the present invention.

Third Important Acoustic Property of Musical Wind Instruments

Figure 4:
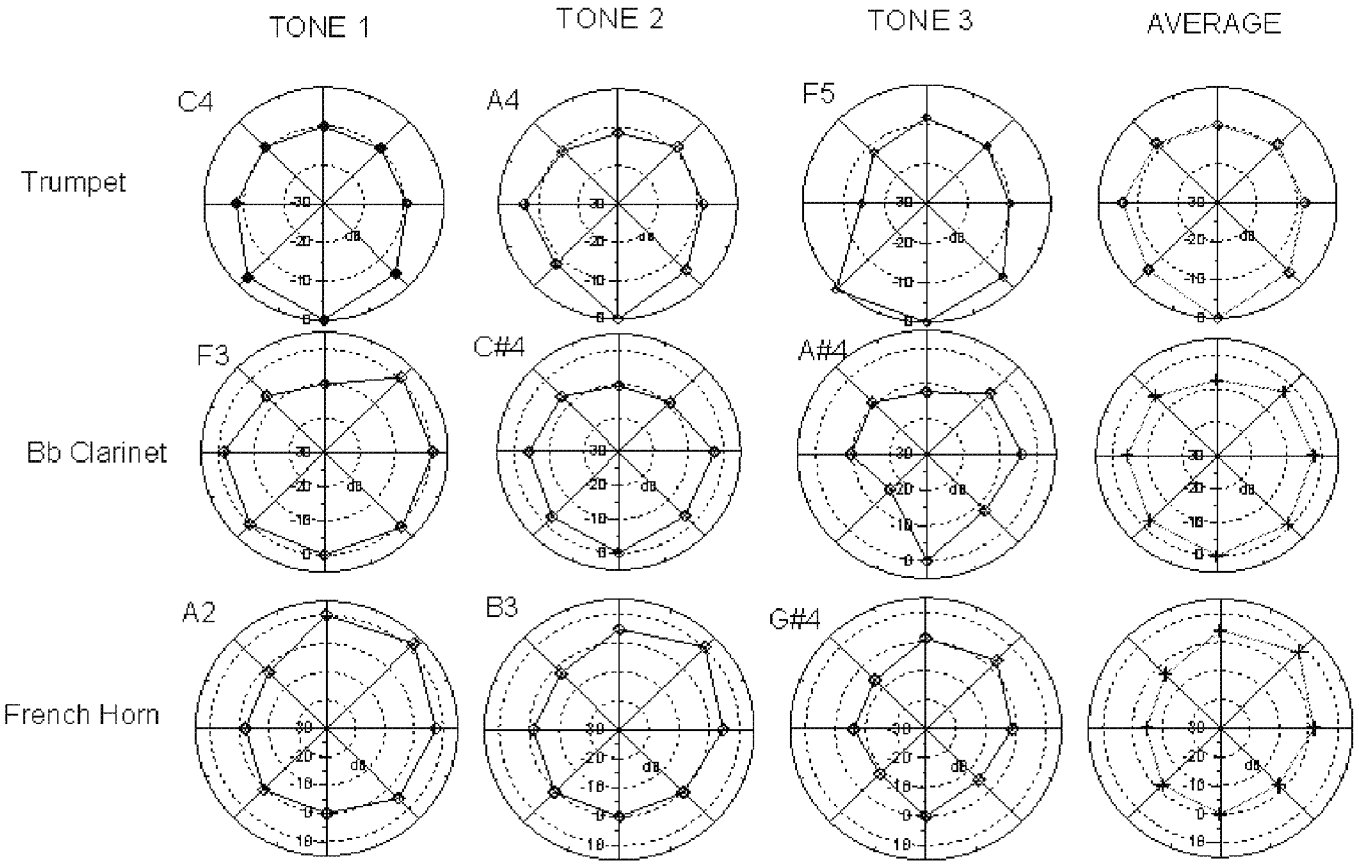
FIG. 4 shows the directional measure of different wind instruments at certain tones or frequencies.

Another important aspect that supports the present invention relates to the radiation of the sound waves emitted, for example, by a trumpet in the horizontal plane. In order to obtain these measurements, various microphones are placed around a circumference, at certain distance from the trumpet, so that the trumpet remains in the center of the circumference and surrounded by said microphones. When certain musical note is played with the trumpet, the sound wave produced will reach said microphones which will in turn measure the loudness at that point. By plotting these measurements, we obtain what is known as the trumpet sound radiation graph. The trumpet sound radiation indicates the perceived loudness for that musical note, if we place ourselves at the points where the microphones are. FIG. 4 shows such a measurement for different wind instruments including a trumpet. For this test, eight microphones were placed surrounding the trumpet in the horizontal plane, and at forty five degrees from each other.

FIG. 4 shows the characteristic that trumpets are practically omnidirectional musical instruments. This means that no matter where we place ourselves relative to the trumpet, the sound it emits will reach us almost with the same loudness at that point.

Construction of the present invention based on the acoustic properties of wind instruments, particularly trumpets and its mouthpieces, explained above.

The present invention uses a high efficiency, full range speaker that is placed in a so called "Tapered nozzle" pathing. The tapered nozzle of the present invention can be manufactured from any suitable material, particularly from solid pinewood, and it is shaped by a mechanical wood turning lathe in both the external part and the inner hollow profiles. The hollow profiles with cylindrical and tapered forms within the tapered nozzle direct the air pressure produced by the cone of the speaker towards the wind instrument, such as a real trumpet. This is achieved as follows.

It is important to emphasize that the tapered nozzle that accommodates the speaker of the present invention can be manufactured preferably with solid pinewood because of the acoustic properties of this kind of wood. All soundboards or front covers of string instruments, including the piano, are manufactured with this kind of wood due to its acoustic properties.

In the larger diameter portion of the tapered nozzle the high efficiency speaker is introduced, and the smaller diameter portion of the tapered nozzle is connected to the end of a duct which may be "U"-shaped. The other end of the duct connects to the mouthpiece of a trumpet hermetically welded, for example, with tin solder. The trumpet mouthpiece is located in turn at the entrance of said wind musical instrument. The reason of making a "U"-shaped duct and connect it to the end of the smaller diameter of the tapered nozzle by one of its ends, and to the trumpet entrance by its other end, is because in this way both the high efficiency speaker and trumpet bell will be "facing" to the front of the person listening music with this system.

The set of elements, high efficiency speaker, tapered nozzle, "U"-shaped duct, trumpet mouthpiece, and trumpet, form together the high musical definition acoustic resonator, which is an object of the present invention. Finally, all of these elements that form the acoustic resonator of the present invention can be set on a stand or pedestal with a base.

Figure 8:
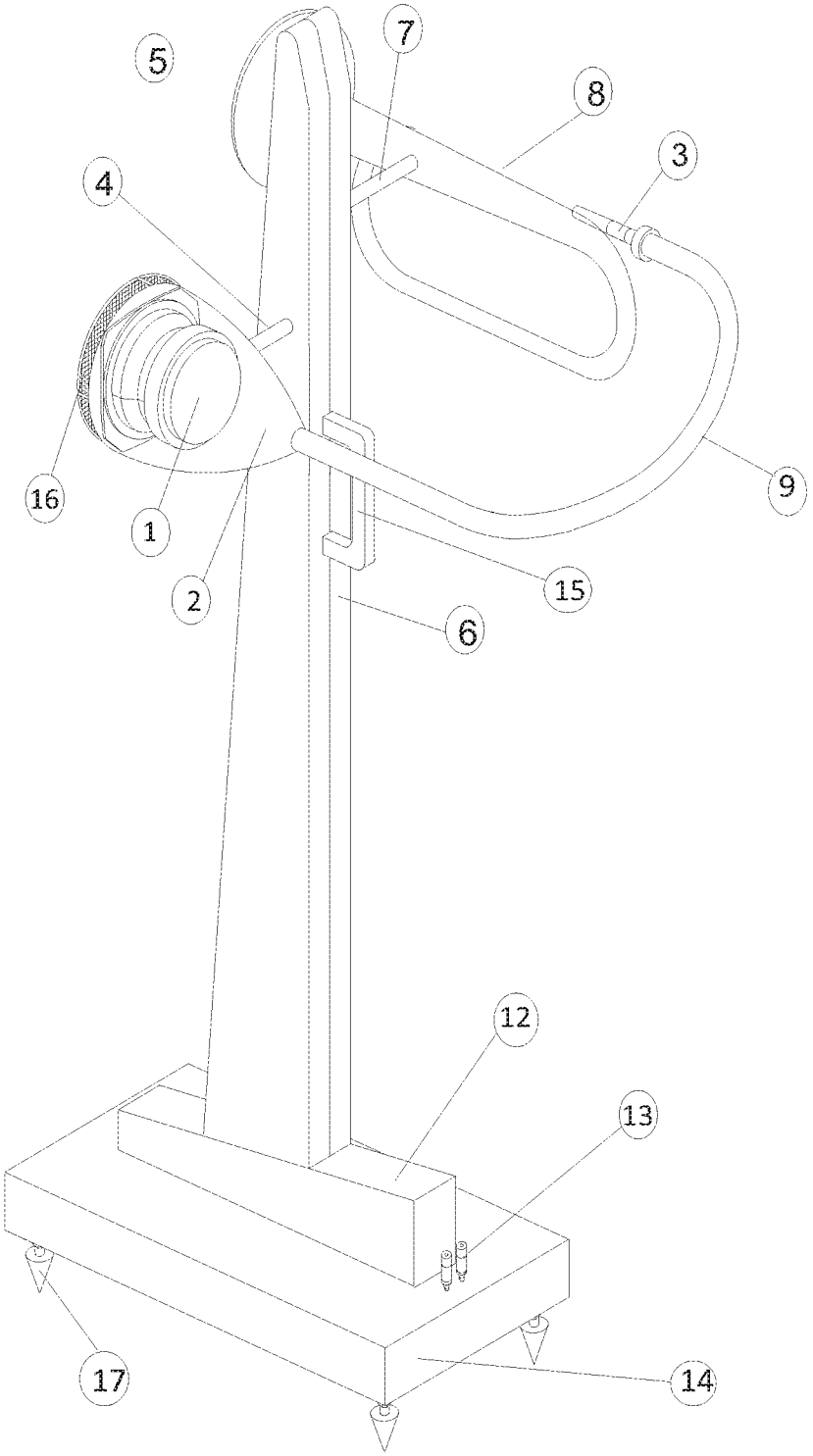
FIG. 8 shows the elements of the acoustic resonator of the present invention, supported on a base.

The connectors that will receive the electrical signal from the audio amplifier are located on the base of the pedestal. The stand or pedestal rise to such a height, that high efficiency speaker matches our ears when we are sitting, for example, in the couch of a living room, in order to listen the system much better. FIG. 8 shows a side view in perspective of the present invention.

When the speaker cone moves forward, with a proportional movement of the electrical signal reaching its connections, air pressure is generated in front of it, and air suction in the trumpet bell. When the speaker cone moves backward, with a proportional movement of the electrical signal reaching its connections, air suction is generated in front of it and air pressure in the trumpet bell. This alternative forward and backward movement of the speaker cone makes an air "column" vibrate inside the trumpet and the tapered nozzle with the same oscillation frequency of the speaker cone. This air column is precisely the acoustic volume flow U that forms part of the acoustic impedance Z equation, explained above. When the vibration frequencies of this air column matches the acoustic impedance peaks of the trumpet, the sounds corresponding to those frequencies will be acoustically amplified by the trumpet, as also explained above. Simultaneously, the trumpet will introduce harmonics at both audible harmonic frequencies and high non-audible harmonic frequencies. The non-audible harmonics frequencies will electrically stimulate our brain, thereby favorably changing our perception of music, as also explained above. Finally, the loudness radiated by the trumpets (trumpet sound radiation) will be almost constant and independent of our position relative to the trumpets, thus uniformly distributing the acoustic power almost in any point of the room in which we are listening to music. This concept was also explained above.

Said three important acoustic trumpet properties, along with the tapered nozzle air flow path, high-efficiency, full range speaker, "U"-shaped duct and trumpet with its mouthpiece, render the acoustic resonator of the present invention in a high musical definition loudspeaker.

Figure 5:
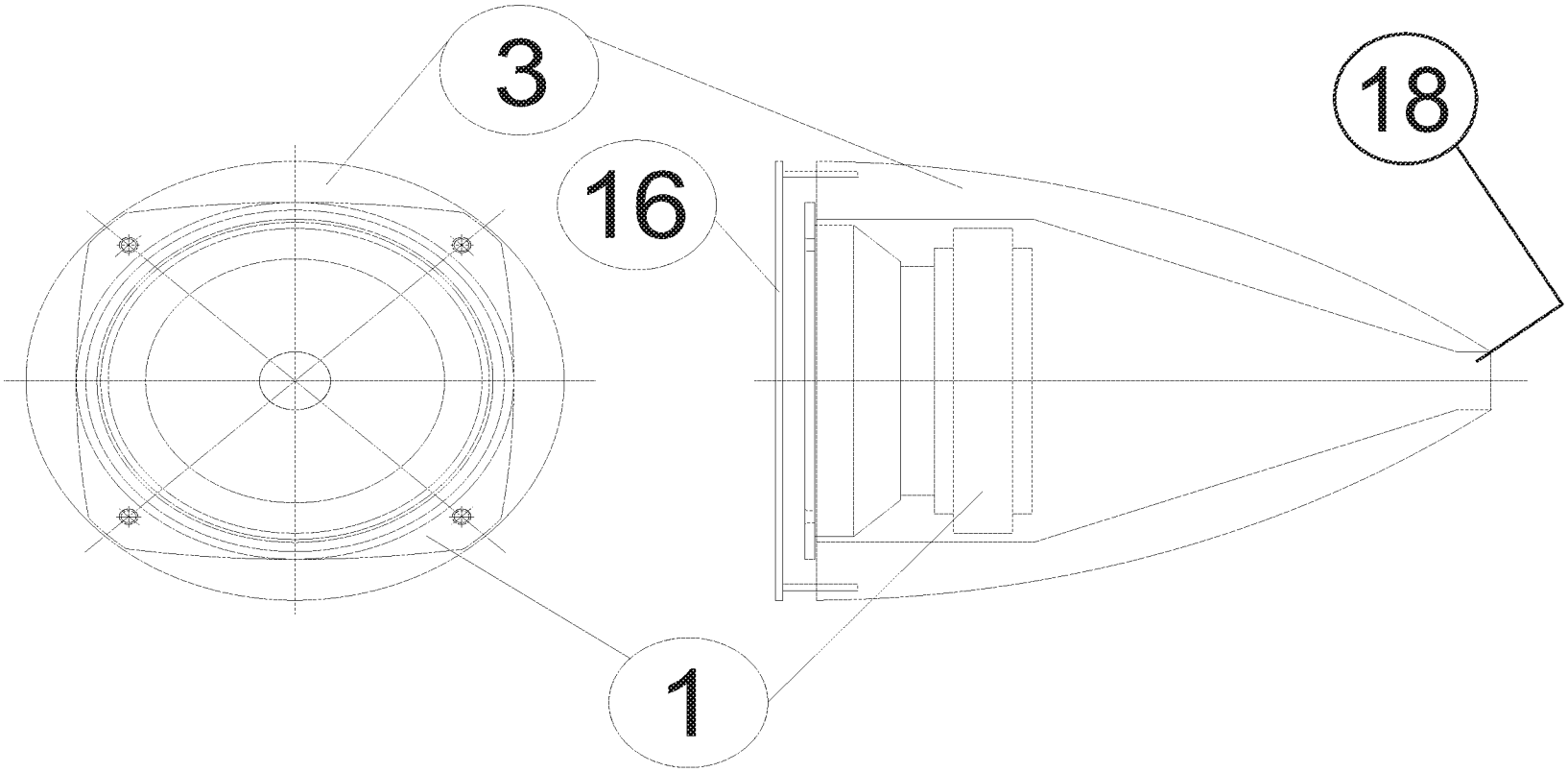
FIG. 5 is a front view and a side view of the tapered nozzle and the speaker of the present invention.

FIG. 5 shows a front view and a side view of the tapered nozzle (3) and speaker (1). The speaker (1) is placed inside the tapered nozzle (3) and can have a protective grill (16) for the speaker (1). The inner part of the tapered nozzle (3) is made up by two hollow profiles. One of them, the larger diameter portion, is a cylindrical profile that allows the speaker (1) to be placed inside it, the other one, the smaller diameter portion, is a tapered profile that allows directing the air flow produced by the speaker (1) to the exit of the tapered nozzle (3).

Figure 6:
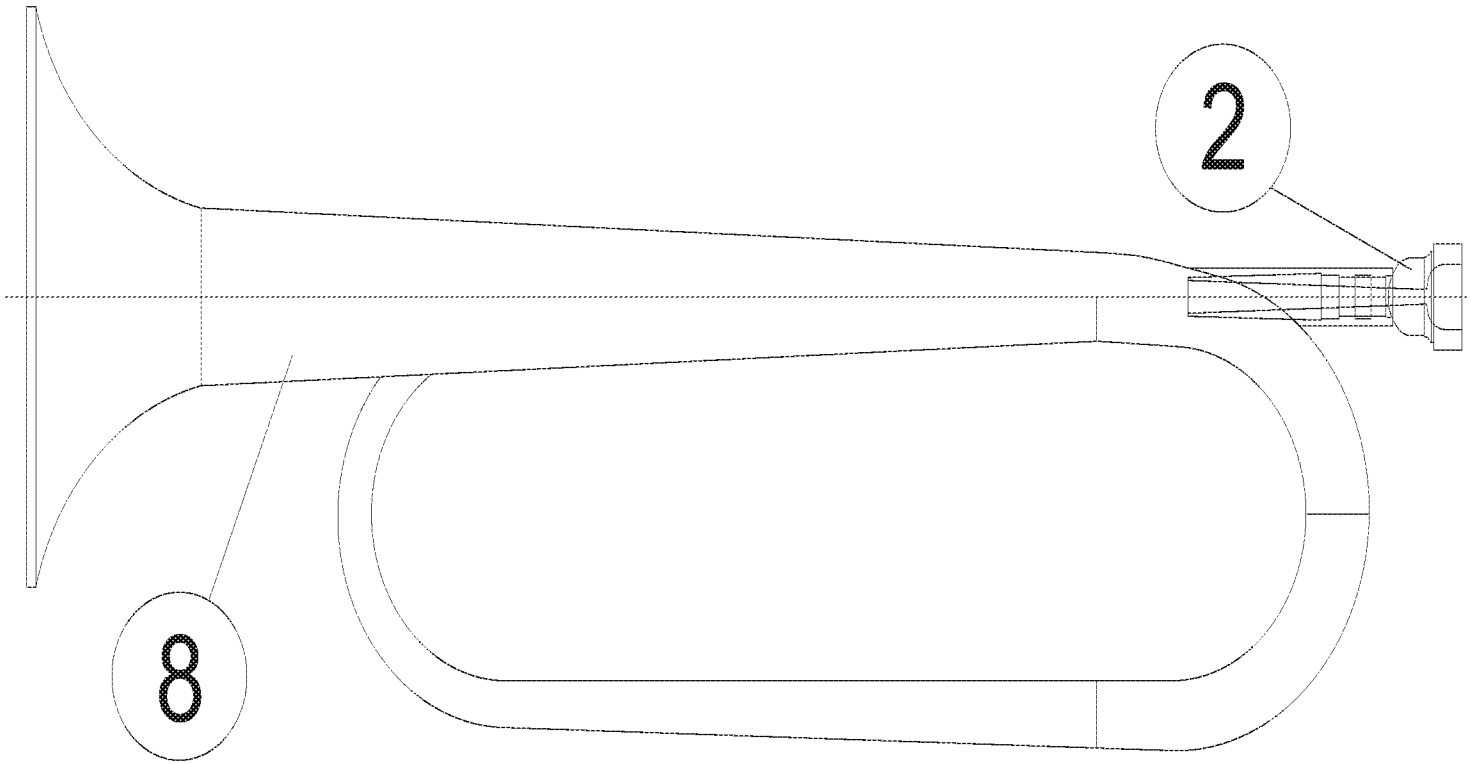
FIG. 6 shows a trumpet and its respective mouthpiece.

FIG. 6 shows a trumpet (8) with its respective mouthpiece (2). The mouthpiece (2) is connected to an air output (18) of the tapered nozzle (3).

Figure 7:
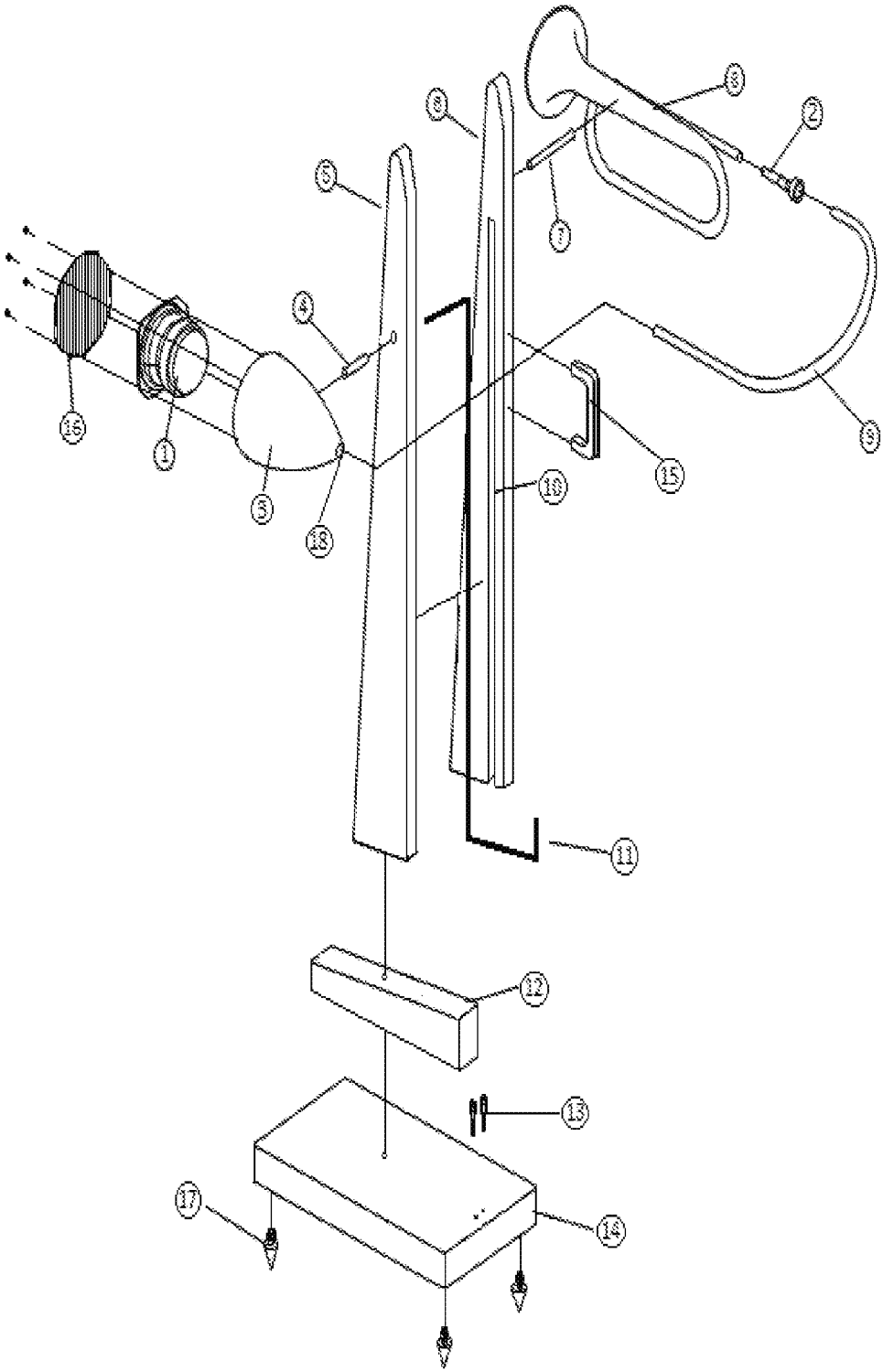
FIG. 7 is an exploded view of the components of the present invention.

FIG. 7 is an exploded view of the components of the present invention. The air output (18) of the tapered nozzle (3) is connected at one of its ends to a "U"-shaped duct (9), and at the other end, the "U"-shaped duct is connected to the mouthpiece (2) of the trumpet (8). The speaker (1), tapered nozzle (3), "U"-shaped duct (9), trumpet mouthpiece (2), and trumpet (8) form together the high musical definition acoustic resonator, which is an object of the present invention. The metallic grill (16) is used only to protect the speaker (1).

In the embodiment of FIG. 7, it is possible to see that the tapered nozzle (3) can be fastened by means of a small brass tube (4) to one of side supporting posts (5). Moreover, it can be seen that the trumpet (8) can be similarly fastened with a small brass tube (7) to the other side supporting post (6). It can also be seen that side supporting posts (5) and (6) have a slot (10) inside. Electrical connecting cables (11) pass through said slot (10) when the two side supporting ports (5) and (6) are joined together. Said electrical connecting cables (11) are connected at one of their ends to connectors (13), and at the other end, to the speaker (1) after having passed through the small brass tube (4) and tapered nozzle (3). A supporting base (14) is also illustrated. In the top of said supporting base (14) said electrical connectors (13) are fixed, at which the electrical signal from the audio amplifier will arrive. In the bottom of the supporting base (14) bronze or brass speaker spikes (17) can be screwed, said spikes serve to penetrate carpets, if applicable, to better anchor the whole system. On the same base (14), an aesthetic element (12) can be fixed. Finally, the whole support with base (5), (6), (12) and (14) can have a handle (15) to hold and move the whole system where appropriate.

The protective grill (16) can be manufactured with brass, for visual aesthetic purposes, but it could well be manufactured with any kind of material such as plastic, stainless steel, fabric, or any combination thereof.

Similarly, the tapered nozzle (3) can be manufactured with solid pinewood because of the acoustic properties of this kind of wood, but it can also be made from any other kind of material such as glass, plastic, any metal, marble, stone, or any combination thereof.

The "U"-shaped duct (9) and trumpet (8) can be manufactured with brass due to its acoustic properties. The "U"-shaped duct (9) can also be elaborated using plastic or any other kind of metal, one could even use a hose of any material to replace this duct, and it would fulfill the same function. Similarly, the trumpet (8) can be made from plastic, wood, or any other kind of material.

As mentioned above, while the use of a trumpet provides very advantageous acoustic properties, other musical wind instruments such as flutes, trombones, English horn, French horn, saxophones, and so on can also be used Having said that, the base support (5), (6), (12) and (14) can also be made from pinewood, however, it could well be made from any other material such as tube, stone, marble, metal, plastic or any combination thereof. It could even change its form, since its final function is only to support the acoustic resonator made up by the speaker (1), tapered nozzle (3), "U"-shaped duct (9), trumpet mouthpiece (2), and trumpet (8).

FIG. 8 shows the elements of the whole system, already assembled. In this figure, one can notice how the speaker (1) is located inside the tapered nozzle (3) and how all the elements of the system interact.

Figure 9:
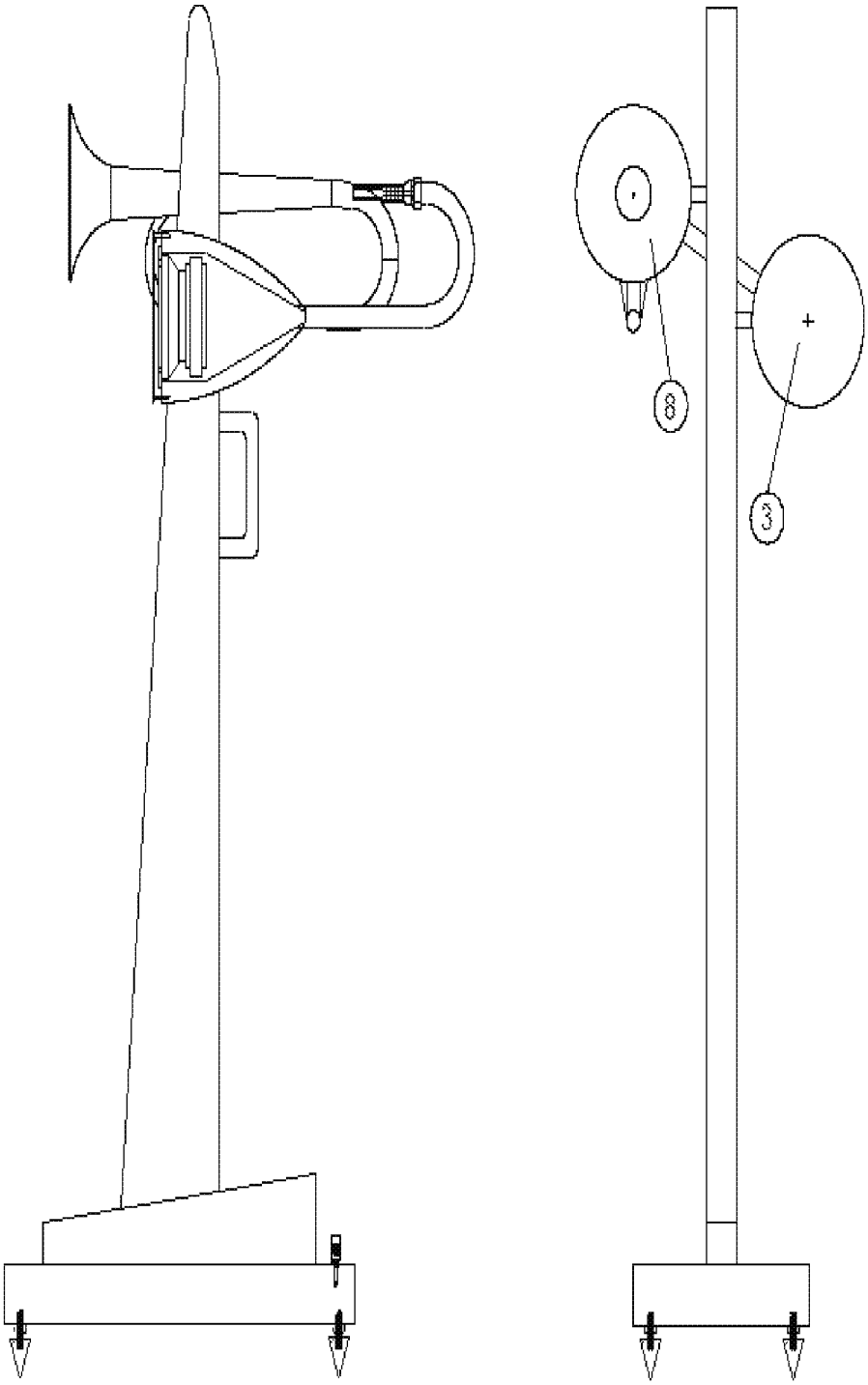
FIG. 9 shows a side view and a front view of the acoustic resonator of the present invention, supported on a base.

FIG. 9 shows a side and a front view of the assembled system.

What is claimed:

1. An acoustic resonator for a musical wind instrument, comprising:

a tapered nozzle including a smaller diameter portion and a large diameter portion;

a speaker placed inside the larger diameter portion of the tapered nozzle; and a duct connected, at one end, to the smaller diameter portion of said tapered nozzle, and at the other end, connected to the musical wind instrument, wherein air produced by said speaker passes through said tapered nozzle, from the tapered nozzle into the duct, and enters into said wind musical instrument from the duct, making it resonate.

2. The acoustic resonator of claim 1, wherein the tapered nozzle is made up by two inner hollow profiles, a first cylindrical profile in said larger diameter portion of said tapered nozzle, that allows said speaker to be placed inside said tapered nozzle, and a second tapered profile in said smaller diameter portion of said nozzle, that allows directing the air produced by said speaker to said duct.

3. The acoustic resonator of claim 1, wherein said duct is "U"-shaped.

4. The acoustic resonator of claim 1, wherein said duct is made from brass.

5. The acoustic resonator of claim 1, wherein said musical wind instrument is selected from the group consisting of a trumpet, flute, trombone, English horn, French horn, saxophone and other wind instruments.

6. The acoustic resonator of claim 5, wherein said musical wind instrument is a trumpet.

7. The acoustic resonator of claim 5, wherein said trumpet further comprises a mouthpiece excited with the speaker.

8. The acoustic resonator of claim 1, wherein the tapered nozzle, the speaker and the duct are set on a support with a base.

9. The acoustic resonator of claim 1, wherein said speaker is a full range speaker for frequencies of between 20 Hertz to 20,000 Hertz.

10. The acoustic resonator of claim 1, wherein said full range speaker minimizes distortion of audio quality.

11. An acoustic resonator for a musical wind instrument, comprising:

a tapered nozzle including a smaller diameter portion and a large diameter portion;

a speaker placed inside the larger diameter portion of the tapered nozzle; and a duct connected, at one end, to the smaller diameter portion of said tapered nozzle, and at the other end, connected to the musical wind instrument, wherein the tapered nozzle is made up by two inner hollow profiles, a first cylindrical profile in the larger diameter portion of the tapered nozzle that allows the speaker to be placed inside the tapered nozzle, and a second tapered profile in the smaller diameter portion of the tapered nozzle that allows directing air produced by the speaker to the duct.

* * * * *